US010124595B2

(12) United States Patent
McNeilly et al.

(10) Patent No.: US 10,124,595 B2
(45) Date of Patent: Nov. 13, 2018

(54) INK CARTRIDGE

(71) Applicant: Hewlett-Packard Development Company, L.P., Houston, TX (US)

(72) Inventors: John McNeilly, Dublin (IE); Coilin Hegarty, Dublin (IE); Bryan Murphy, Lucan (IE); Fiona Coyle, Dublin (IE); Kevin Rourke, Leixlip (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 1 day.

(21) Appl. No.: 15/025,650

(22) PCT Filed: Sep. 30, 2013

(86) PCT No.: PCT/US2013/062582
§ 371 (c)(1),
(2) Date: Mar. 29, 2016

(87) PCT Pub. No.: WO2015/047382
PCT Pub. Date: Apr. 2, 2015

(65) Prior Publication Data
US 2016/0236477 A1 Aug. 18, 2016

(51) Int. Cl.
*B41J 2/175* (2006.01)

(52) U.S. Cl.
CPC ..... *B41J 2/17553* (2013.01); *B41J 2/1752* (2013.01); *B41J 2/17513* (2013.01)

(58) Field of Classification Search
CPC ... B41J 2/17553; B41J 2/1752; B41J 2/17513
See application file for complete search history.

(56) References Cited

U.S. PATENT DOCUMENTS

| | | | | |
|---|---|---|---|---|
| 4,325,646 | A * | 4/1982 | Sasaki | B41J 32/02 400/196.1 |
| 6,270,207 | B1 | 8/2001 | Sasaki | |
| 6,733,115 | B2 | 5/2004 | Santhanam et al. | |
| 6,796,646 | B2 | 9/2004 | Komplin et al. | |
| 7,384,137 | B2 | 6/2008 | Putman | |
| 7,445,323 | B2 | 11/2008 | Anderson et al. | |
| 7,475,972 | B2 | 1/2009 | Qingguo et al. | |
| 2003/0035035 | A1 * | 2/2003 | Komplin | B41J 2/1752 347/86 |
| 2003/0184628 | A1 | 10/2003 | Sasaki | |

(Continued)

FOREIGN PATENT DOCUMENTS

EP 1038678 A1 9/2000

OTHER PUBLICATIONS

PCT International Search Report and Written Opinion, dated Jun. 16, 2014, PCT Patent Application No. PCT/US2013/062582, Hewlett-Packard Development Company, L.P., Korean Intellectual Property Office, 11 pages.

*Primary Examiner* — Justin Seo
(74) *Attorney, Agent, or Firm* — Fabian VanCott

(57) ABSTRACT

An ink cartridge is disclosed that includes a single cast reservoir portion of a first polymer configuration, the reservoir portion including raised walls that extend up to a top edge, the raised walls including a back wall. A latch handle protrudes from the back wall. A single cast lid is attached to the top edge. The lid is of a second polymer configuration that is stronger than the first polymer configuration.

17 Claims, 5 Drawing Sheets

(56) References Cited

U.S. PATENT DOCUMENTS

| | | | | |
|---|---|---|---|---|
| 2004/0165045 | A1* | 8/2004 | Sakai | B41J 2/17513 347/86 |
| 2005/0151811 | A1* | 7/2005 | Shimizu | B41J 2/1752 347/86 |
| 2008/0018720 | A1 | 1/2008 | Fukushima et al. | |
| 2008/0021170 | A1* | 1/2008 | Fukushima | B41J 2/17513 525/340 |
| 2008/0165214 | A1* | 7/2008 | Yuen | B41J 2/17566 347/7 |
| 2008/0204524 | A1* | 8/2008 | Petranek | B41J 2/1752 347/86 |
| 2012/0198686 | A1 | 8/2012 | Kitagawa et al. | |
| 2015/0035915 | A1* | 2/2015 | Murphy | B41J 2/17513 347/86 |
| 2016/0152038 | A1* | 6/2016 | Sittampalam | B41J 2/1752 347/86 |
| 2017/0165976 | A1* | 6/2017 | Paranan | B41J 2/17553 |

* cited by examiner

INK CARTRIDGE

CROSS-REFERENCE TO RELATED APPLICATION

This application is a U.S. National Stage Application of and claims priority to International Patent Application No. PCT/US2013/062582, filed on Sep. 30, 2013, and entitled "INK CARTRIDGE," which is hereby incorporated by reference in its entirety.

BACKGROUND

Oftentimes ink cartridges have certain predefined design constraints such as outer dimensions, latch features, fluidic interconnect features, certain back pressure mechanisms, etc. There is a desire for ink cartridges to hold relatively large amounts of ink at relatively low manufacturing costs, and while respecting these predefined design constraints.

BRIEF DESCRIPTION OF THE DRAWINGS

For the purpose of illustration, certain examples constructed in accordance with this disclosure will now be described with reference to the accompanying drawings, in which.

DETAILED DESCRIPTION

In the following detailed description, reference is made to the accompanying drawings. The examples in the description and drawings should be considered illustrative and are not intended as limiting to the specific example or element described. Multiple examples can be derived from the following description and drawings through modification, combination or variation of the different elements.

Figure 1:
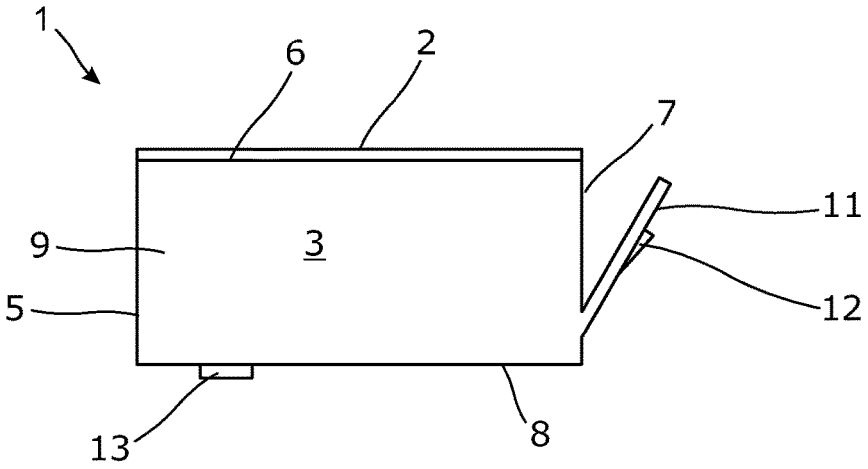
FIG. 1 illustrates an example ink cartridge in side view.

FIG. 1 illustrates an ink cartridge 1. The ink cartridge 1 includes a single cast reservoir portion 3 having a lid 2 on top. The reservoir portion 3 includes raised walls 5, 7, 9 including a front wall 5, a back wall 7, and two side walls 9. The raised walls 5, 7, 9 define a common top edge 6 to which the lid 2 is attached. The reservoir portion further includes a bottom wall 8. The reservoir walls 5, 7, 8, 9 form at least one reservoir chamber to hold ink. The reservoir portion 3 is defined by a single cast shape, integrally molded in a single mold.

The single cast reservoir portion 3 includes a latch handle 11 that protrudes from the back wall 7 and is integrally molded with the back wall 7. The latch handle 11 may be defined as a generally rectangular handle hingeable with respect to the back wall 7. The latch handle 11 includes a latch bump 12 protruding outwards. The latch bump 12 is to engage a corresponding printer latch element to latch the cartridge 1 to the printer. Also the latch bump 12 is to disengage from the printer latch element to remove the cartridge 1 from the printer. For example the latch handle 11 hinges inwards when pushing the cartridge 1 downwards into a latched position in the printer, and hinges outwards into latched position when the latch bump 12 passes the corresponding printer latch element. The latch handle 11 can be manually hinged inwards again to release the latch bump 12 and remove the cartridge 1 from the printer.

The single cast reservoir portion 3 further includes a fluidic interconnect 13 protruding from the bottom wall 8, near the front wall 5. The fluidic interconnect 13 includes a cylindrical wall. The fluidic interconnect 13 is to interconnect with a corresponding printer fluidic interconnect. The fluidic interconnect 13 may support a filter to hold and transport ink. The filter may extend within and/or over the cylindrical wall. The foam in the ink chamber is fluidically connected to the filter.

The reservoir portion 3 is manufactured of a polymer resin that may be of relatively low cost as compared to the polymer configuration of the lid 2. The reservoir polymer can be a high melt flow rate copolymer, for example having a melt flow rate (at 230° C./2.16 kg) of at least 15 g/10 min or of at least 20 g/10 min, for example approximately 24 g/10 min, for example based on a standard test method such as ASTM D 1238 or ISO 1133 or the like. The reservoir portion 3 includes a polymer configuration that has a relatively low impact strength, as compared to the polymer configuration of the lid 2. For example, the reservoir polymer may be relatively brittle as compared to the lid polymer. For example, the polymer has an Izod Impact Strength of approximately 106 J/m or less, for example approximately 53 J/m, based on ASTM D 256, Method A, at approximately 23° C. For example the reservoir portion 3 is made of PP (Polypropylene), for example low impact PP. The polymer configuration of the reservoir portion 3 may have a lower impact strength and a higher melt flow rate than the polymer configuration of the lid 2.

The lid 2 is mounted to the top edge 6 of the raised walls 5, 7, 9 to seal the inner chamber. The lid 2 may include a substantially flat base having a substantially rectangular circumferential edge to connect to the top edge 6. The lid 2 is separately molded from the reservoir portion 3. The lid 2 is defined by a single cast part, molded in a single mold process. In one example manufacturing method, the lid 2 is adhered to the reservoir portion 3 after foam has been placed in the reservoir portion 3.

The lid 2 is composed of a stronger polymer resin than the reservoir polymer. The lid polymer can have a relatively lower melt flow rate copolymer, for example having a melt flow rate (at 230° C./2.16 kg) of approximately 14 g/10 min or less, or of approximately 10 g/10 min or less, for example approximately 8 g/10 min, for example based on a standard test method such as ASTM D 1238 or ISO 1133 or the like. For example, the lid 2 includes a polymer configuration that has a relatively high impact strength as compared to the reservoir portion 3. For example the polymer of the lid has a notched Izod impact strength of at least approximately 25 kJ/m2, or of approximately 50 kJ/m2, based on a standard test method such as IS0180/1A at approximately 23° C. The polymer configuration of the lid 2 may also have a higher tensile strength than the polymer configuration of the reservoir portion 3. For example the lid 2 is made of PP, for example high impact PP. The polymer configuration of the lid 2 may have a lower melt flow rate, higher impact strength and higher tensile strength than the polymer configuration of the reservoir portion 3. While in this example the lid 2 and reservoir portion 3 are both made of different types PP, in other examples they can be made of different polymers, different resins, etc.

For reliable seal and vent functions, the lid 2 may be composed of stronger polymer configuration, while the larger reservoir portion 3 can be made of less strong, cheaper polymer configuration. This may allow for a generally cheap, relatively low environmental foot print cartridge 1 that at the same time is capable of holding relatively large ink volumes. The disclosed cartridge 1 may allow for effective use of both ink and resins, within predefined design constraints such as outer dimensions.

Figure 2:
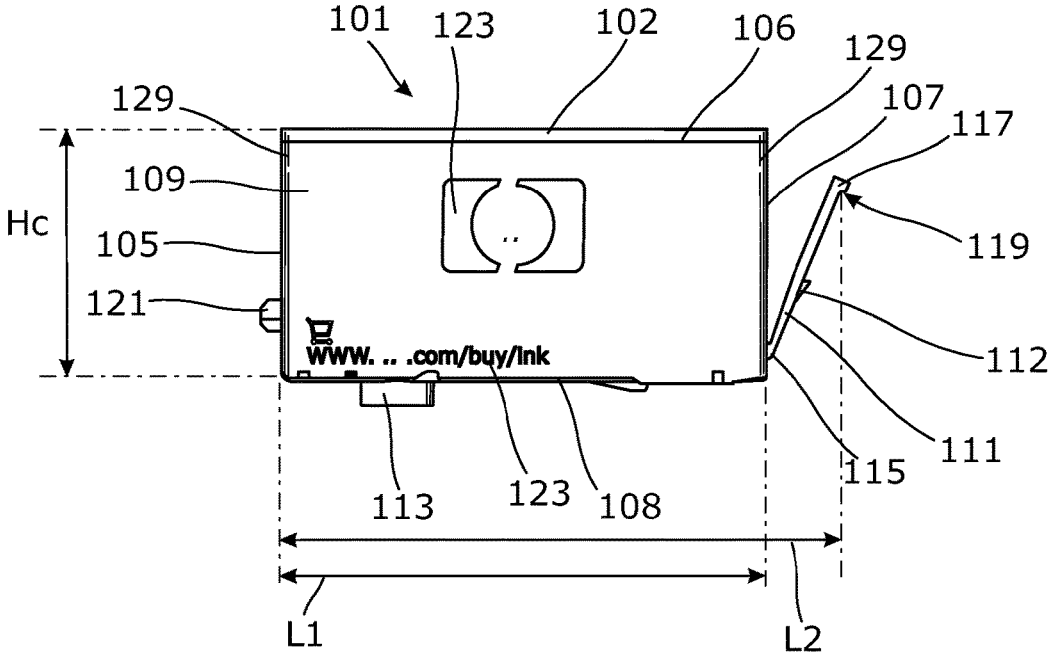
FIG. 2 illustrates another example ink cartridge in side view.

FIG. 2 illustrates another example of an ink cartridge 101, in side view. The ink cartridge 101 includes a single cast reservoir portion 103, and a single cast lid 102 attached on top of the reservoir portion 103. The reservoir portion 103 includes integrally molded raised walls 105, 107, 109, extending up to a common top edge 106, including a front wall 105, back wall 107 and two opposite side walls 109. The reservoir portion 103 further includes a bottom wall 108. The bottom wall 108 and raised walls 105, 107, 109 enclose inner ink chambers that are sealed by the top lid 2. The reservoir portion 103 includes a latch handle 111 protruding from the back wall 107. For example the latch handle 111 has an angle of between approximately 15 and 30° with respect to the back wall 107. The latch handle 111 is to hinge about a living hinge 115. For example, near the hinge 115 the latch handle inner surface is angled at about 18 to 21° with respect to the back wall 107. The latch handle 111 includes a latch bump 112 to engage a corresponding printer latch element. A distal end of the latch handle 111 may include a protruding grip feature 117. The grip feature 117 may be defined by a thickening of the handle 111 at said end, forming just below the end a curved engagement rib 119 to facilitate a better finger grip.

The reservoir portion 103 includes a cylindrical fluidic interconnect 113 protruding from the bottom wall 108, holding a fluidic interconnect filter that in turn is fluidically connected to foam in the inner ink chambers, to transport ink from the inner chambers to a corresponding printer fluidic interconnect. The fluidic interconnect 113 may be disposed near the front wall 105. The reservoir portion 103 may include a key profile 121 protruding from the front wall 105. The key profile may be I, T- or L shaped, for example.

In one example the reservoir portion 103 consist of a low impact, high melt flow rate polymer resin such as low impact PP, as explained above with reference to FIG. 1. The reservoir walls 105, 107, 108, 109 may be opaque. In one example, the reservoir side walls 109 include embossed or impressed symbols 123.

A length L1 of the reservoir portion 103 as measured between the outside of the front wall 105 and the back wall 107 is between approximately 67 and 78 millimeter, for example approximately 72.2 millimeter. For example a length L2 of the reservoir portion 103 as measured between the front wall 105 and the extreme of the latch handle 111, for example formed by the grip 117, is between approximately 79 and 90 millimeter, for approximately 84.6 millimeter. A thickness T of the reservoir portion 103 as measured between outer surfaces of the side walls 109 (FIG. 3) can be between approximately 11 and 13.5 millimeters, for example approximately 12.25 millimeters. The thickness T may be more, for example black cartridges may be wider. For example a height Hc of the cartridge 101 from the top of the lid 102 to the bottom of the bottom wall 108, not counting the fluidic interconnect 113, can be between approximately 33 and approximately 45 millimeters, for example approximately 38 millimeters. For example the key profile 121 protrudes at least 2 millimeter from the front wall 105, for example approximately 3 millimeter. For example the cylindrical wall of the fluidic interconnect 113 protrudes at least approximately 2 millimeters from the bottom wall 108, for example approximately 3 millimeter.

The reservoir portion 103 includes corner fillets 129 connecting the side walls 109 with respective front and back walls 105, 107. For example the radius of the fillets 129 between respective side walls 109 and front or back walls 105, 107 is at least approximately 0.8 millimeter or at least approximately 1.1 millimeter, for example approximately 1.5 millimeters. For example, the living hinge 115 has a radius of at least 0.23 millimeters with respect to the back wall 107, for example approximately 0.28 millimeters. These relatively smooth corners and fillets 129, 115 may make the respective edges stronger, for example to compensate for a relatively low impact strength of the polymer resin of the reservoir portion 103.

Figure 3:
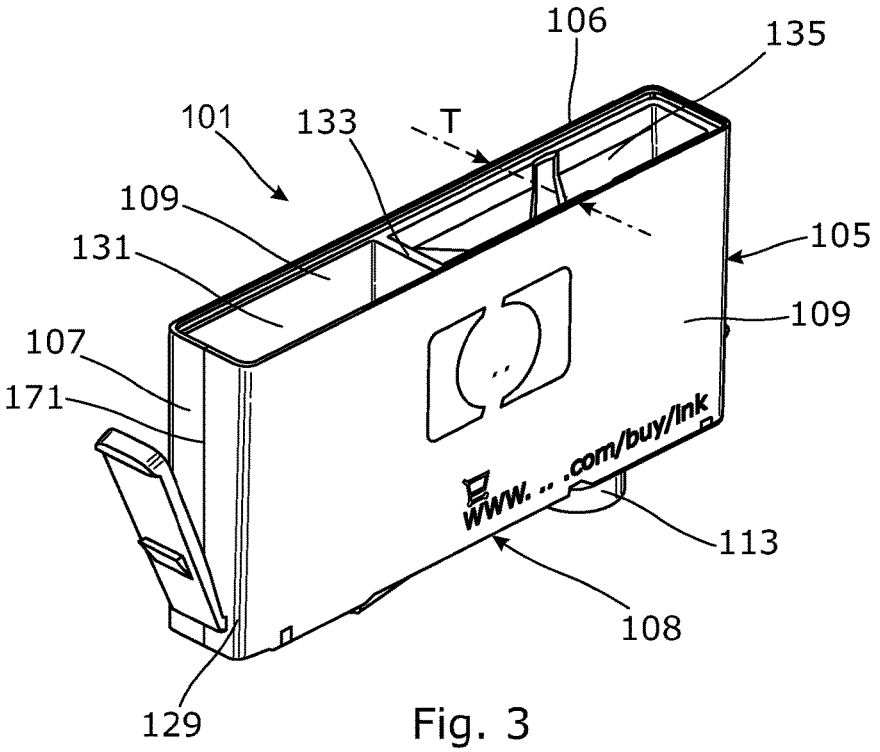
FIG. 3 illustrates an example reservoir portion in perspective view.

FIG. 3 illustrates the example reservoir portion 103 of the cartridge 101 of FIG. 2 separately, without lid 102, in a perspective view. The reservoir portion 103 includes a free ink chamber 131 and a foam chamber 135, separated by a separation wall 133. The foam chamber 135 is to hold foam and ink, above the fluidic interconnect 113 to provide ink to the fluidic interconnect 113. The foam is to retain the ink by capillary action. The fluidic interconnect 113 protrudes from the bottom wall 108 in a region between the separation wall 133 and the front wall 105. The foam chamber 135 is defined by the front wall 105, separation wall 133, side walls 109, bottom wall 108 and lid 102. The free ink chamber 131 is defined by the back wall 107, separation wall 133, side walls 109, bottom wall 108 and lid 102. In a filled condition, the free ink chamber 131 is filled with ink, without foam. The raised walls 105, 107, 109 and the separation wall 133 may share a common top edge 106, although in some examples a top edge of the separation wall 133 is distanced from the lid 102 to provide for a top fluid exchange port near the top.

Figure 4:
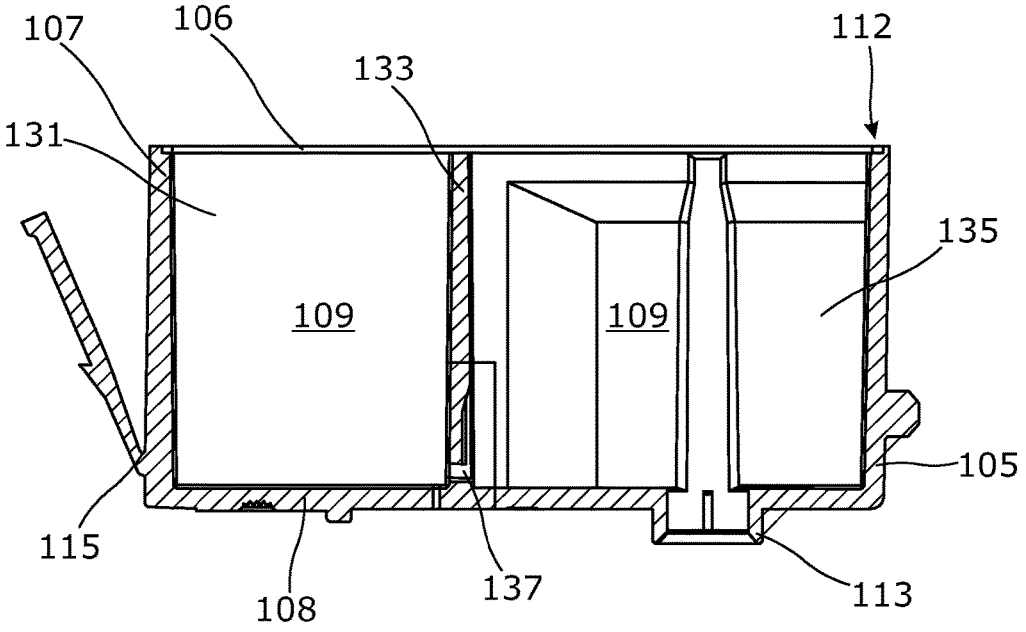
FIG. 4 illustrates the example reservoir portion of FIG. 3 in cross sectional side view.

FIG. 3 further illustrates the relatively smooth fillets 129 between the side wall 109 and the back wall 107. Also illustrated is a mold parting line 171 of the reservoir portion 103. The mold parting line 171 may extend over the middle of the font wall 105 and the middle of the back wall 107, along the height of the respective wall 105, 107. FIG. 4 illustrates the reservoir portion 103 of FIG. 3 in a cross sectional side view. FIG. 4 illustrates the relatively smooth radius of the live hinge 115 with the back wall 107. As illustrated in FIG. 4, the top edge 106 may be stepped. The edge 106 includes a circumferential step 112 to facilitate fitting of the lid 102. The lid 102 may also be provided with a corresponding stepped edge.

As illustrated in FIG. 4, the reservoir portion 103 includes a fluid port 137 that is disposed between the free ink chamber 131 and the foam chamber 135, to fluidically connect the chambers 131, 135. The fluid port 137 can be disposed near the bottom of the separation wall 133, for example just on top of the bottom wall 108. The fluid port 137 can be defined by a bottom edge or an opening of the separation wall 133. The fluid port may suitably allow ink and/or air to pass through.

In one example, the volume of the free ink chamber 131 is at least approximately 6 $cm^3$, or for example at least approximately 6.4 $cm^3$, for example approximately 6.8 $cm^3$. For example the inner volume of the foam chamber 135, as measured in an empty, foamless condition, is between approximately 8.8 and 10 cm3, for example approximately 9.4 cm3. The cartridge 101 may have a total fill rate of at least approximately 11 grams of pigment ink. Different ink colors may have different weights. For example a total ink weight of Cyan ink may be at least approximately 11.2 g, of Magenta ink at least approximately 11.9 g and of Yellow ink at least approximately 11 gram. In another example a filled cartridge 101 allows to print at least 800 pages up until exhaustion, for example at least approximately 825 pages, based on at least one of ISO/IEC 24711 and ISO/IEC 24712 or similar standard testing methods.

Figure 5:
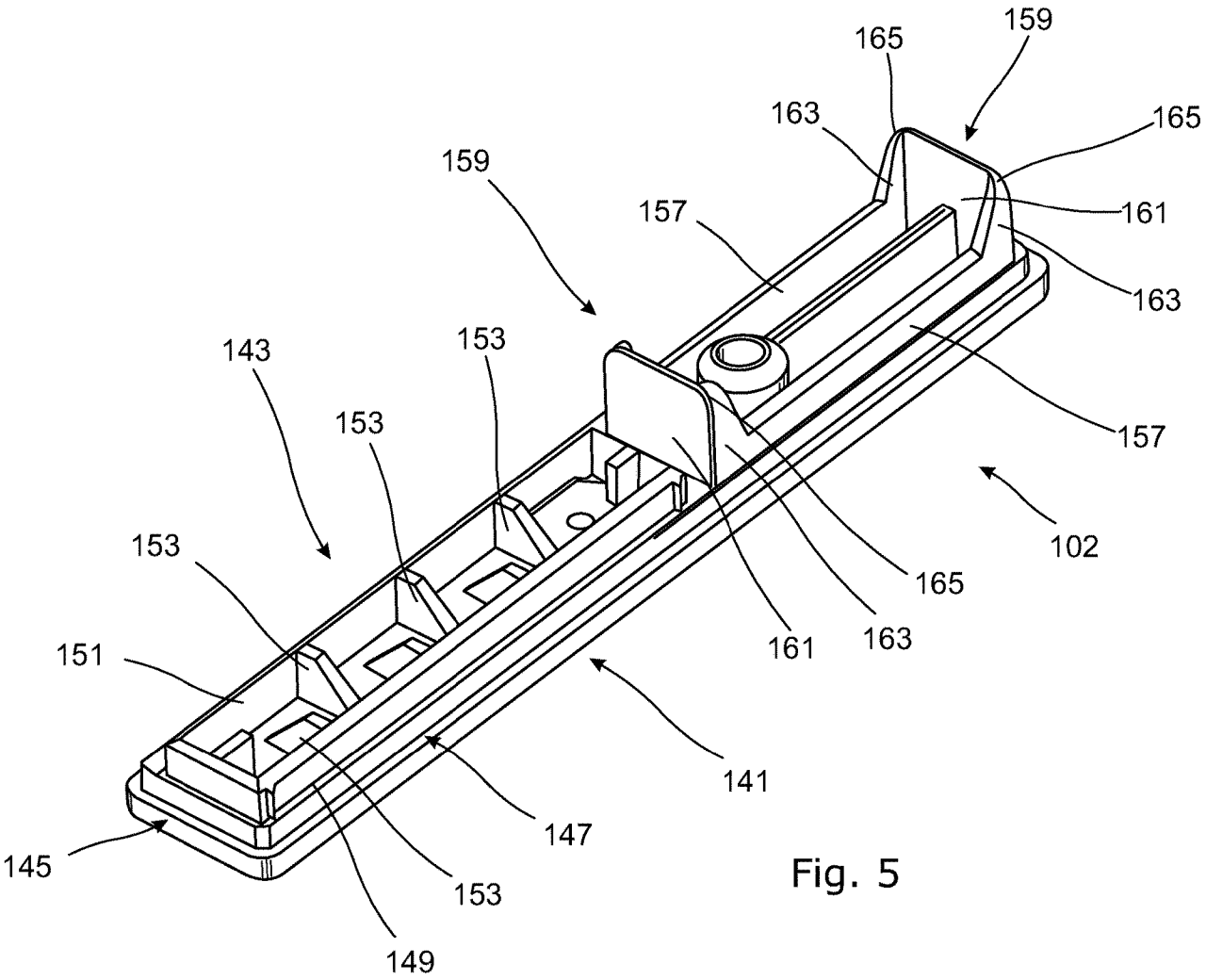
FIG. 5 illustrates an example lid in perspective view.
Figure 6:
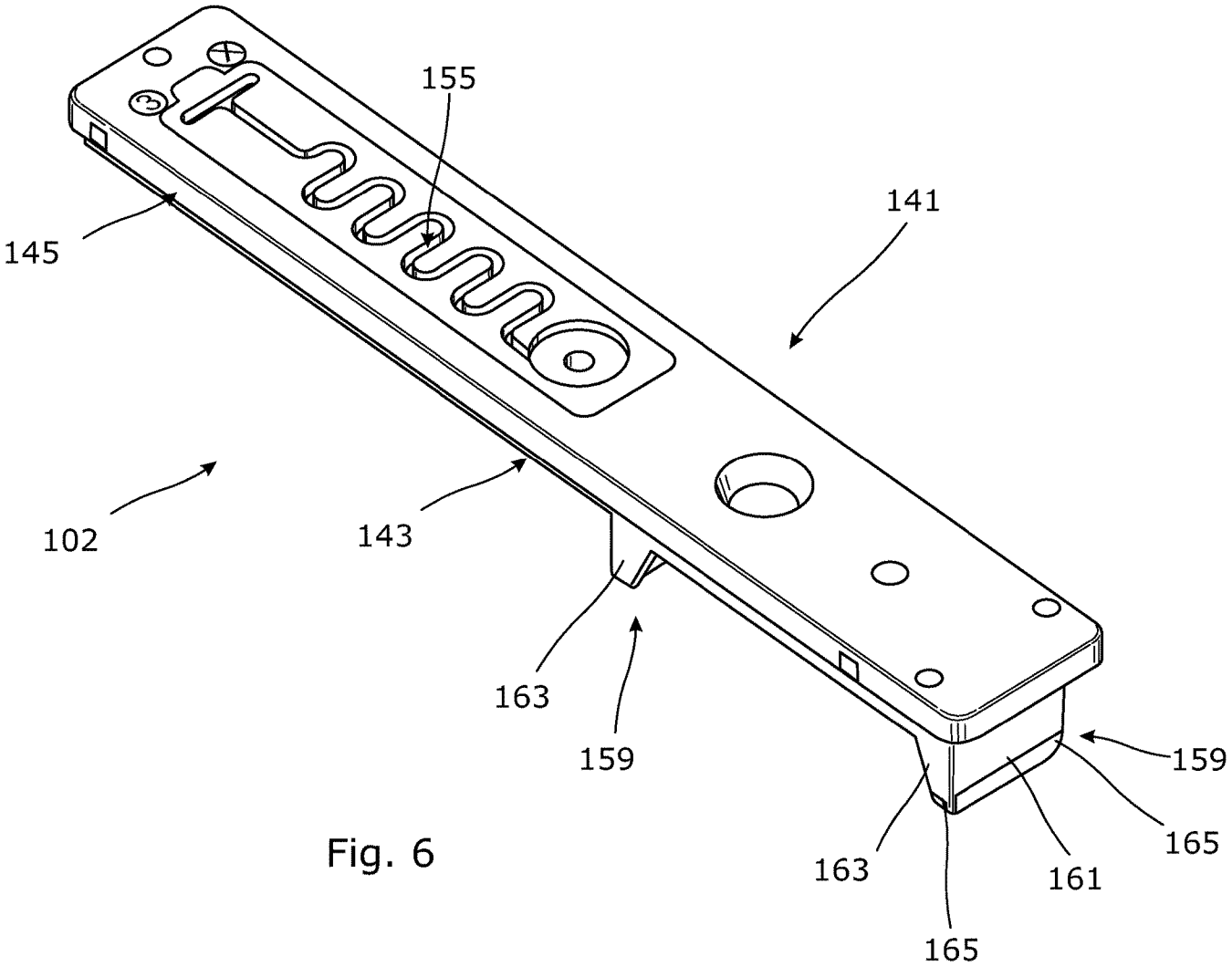
FIG. 6 illustrates the example lid of FIG. 5 in another perspective view.
Figure 7:
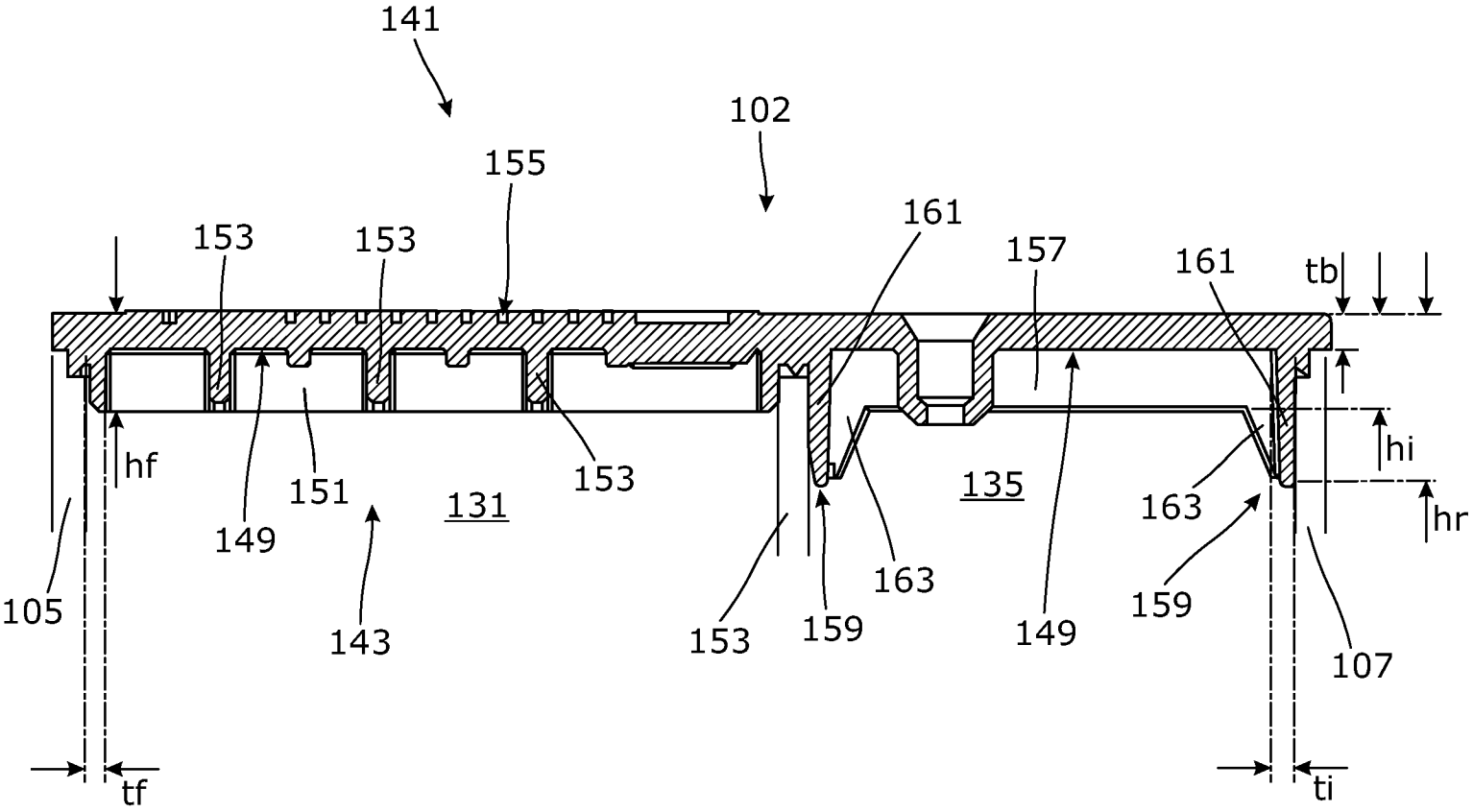
FIG. 7 illustrates the example lid of FIGS. 5 and 6 fitted to an example reservoir, of which only relevant portions are illustrated.

FIGS. 5 and 6 are perspective views of the lid 102 of FIG. 2. FIG. 5 is a view on a bottom 143 of the lid 102 and FIG. 6 is a view on a top 141 of the lid 102. FIG. 7 is a cross sectional side view of the same example lid 102, wherein respective reservoir portion walls 105, 133, 107 are indicated in ghost lines for illustration purposes.

The lid 102 has a top 141 and a bottom 143. The lid 102 has an outer edge 145. For example, the lid bottom 143 includes a circumferential step 147 parallel to the outer edge 145, to fit onto a corresponding step of the top edge 106 of the reservoir portion 103.

The lid 102 further includes a base 149. A series of profiles, anchors and/or ribs may extend from the base into the respective chambers 131, 135. A thickness tb of the lid base 149 may be at least approximately 1 millimeter, for example approximately 2 millimeters.

The lid 102 includes at least one foam chamber retention profile 151 protruding from the bottom base 149, to fit into the foam chamber 131. The foam chamber retention profile 151 is rectangular shaped, to engage inner raised wall portions of the foam chamber 131. For example the foam chamber retention profile 151 engages inner top portions of the front wall 105, the side walls 109 and the separation wall 133 (see FIG. 7). The height hf of the foam chamber retention profile 151 can be at least approximately 2 millimeters, at least 3 millimeters or approximately 3.5 millimeters as measured from the base 149. For example a thickness tf of the foam chamber retention profile 151 is between approximately 0.5 and 2 millimeters. Foam retention ribs 153 are provided within the rectangular profile 151, also protruding from the base 149. The foam retention ribs 153 are to retain the foam, for example to prevent blocking of a vent hole (not shown) that connects to a labyrinth vent 155. The foam retention ribs 153 may have a maximum height similar or equal to the height hf of the free ink chamber retention profile 151, for example at least approximately 2 millimeters, at least 3 millimeters or approximately 3.5 millimeters as measured from the base 149.

The lid 102 further includes a free ink chamber retention profile 157 protruding from the lid base 149 to fit into the free ink chamber 157. The free ink chamber retention profile 157 may be a rectangular profile, to engage the inner walls of the free ink chamber 135. For example the free ink chamber retention profile 157 is to fit to inside top portions of the back wall 107, the side walls 109 and the separation wall 135 (see FIG. 7). A height hi of the free ink chamber retention profile 157 can be at least approximately 2 millimeters, at least 3 millimeters or approximately 3.5 millimeters, as measured from the base 149.

The lid 102 includes at least one anchor 159 protruding from the bottom 143. In the illustrated example two opposite anchors 159 are provided. The anchor 159 is to press fit the lid 102 to the free ink chamber, facilitating a better anchoring of the lid 102 to the reservoir portion 103. The anchor 159 is higher than any of the free ink chamber retention profile 151, the foam retention ribs 153 and the foam chamber retention profile 157, as measured from the base 149. The anchor 159 has a height hr of at least 3.5 millimeters, or for example at least 5 millimeters, for example at least 6.5 millimeters, or for example approximately 7.7 millimeters, as measured from a base 149 of the lid 102 (FIG. 7). In the illustrated example, two opposite anchors 159 are disposed at the short sides of the free ink chamber retention profile 157. In the illustrated example the anchors 159 are flush with the free ink chamber retention profile 157. For example the anchors 159 and the free ink chamber 157 retention profile basically form one integral profile. For example a thickness ti of the profile formed by the anchor 159 and the free ink chamber retention profile 157 is between approximately 0.5 and 2 millimeters.

A main body 161 of the anchor 159 extends parallel to the back wall 107. The anchors 159 are to press fit against the back wall 107 and the separation wall 133. In the illustrated example, the anchor has wings 163 on top of, and flush with, the free ink chamber retention rib, that extend perpendicular to the main body 161. The wings 163 of the opposite anchors 159 point towards each other. For example, the wings 163 are to engage respective side walls 109 of the free ink chamber 135. Each anchor 159 may have rounded corners 165 at its distal end, for example at the corner of the main body 161 with the wings 163. The rounded corners 165 are to aid in press fitting the lid 102 to the reservoir portion 103. The disclosed anchors 159 may facilitate a better attachment and seal of the lid 102 to the reservoir portion.

The above explained example cartridges 1, 101 may hold relatively large amounts of ink within dimensional constraints, for example sufficient to print at least 800 or at least 825 pages, based on ISO/IEC 24711 and/or ISO/IEC 24712 or similar testing methods. While there could be an increased risk of leaking due to high fills and, as a consequence, high pressures inside the cartridge 1, 101, these risks may be moderated by the disclosed polymer resins, anchors 159 and/or other disclosed design features of the cartridge 1, 101. In addition, some of the disclosed construction examples are relatively cost- and material efficient.

The invention claimed is:

1. An ink cartridge, comprising:

a single cast reservoir portion of a first polymer configuration, the reservoir portion including a bottom wall and raised walls that extend up to a circumferential top edge, the raised walls including a front wall, a back wall and two side walls;

a straight, rectangular latch handle protruding from the back wall; and a single cast lid attached to the top edge, of a second polymer configuration that has a lower melt flow rate than the first polymer configuration;

wherein the second polymer configuration is non-reactive with ink.

2. The ink cartridge of claim 1 wherein the second polymer configuration has a higher impact strength than the first polymer configuration.

3. The ink cartridge of claim 1 wherein the reservoir portion includes a free ink chamber and a foam chamber.

4. An ink cartridge, comprising:

a single cast reservoir portion of a first polymer configuration, the reservoir portion including a bottom wall and raised walls that extend up to a circumferential top edge, the raised walls including a front wall, a back wall and two side walls;

a straight, rectangular latch handle protruding from the back wall; and a single cast lid attached to the top edge, of a second polymer configuration that is stronger than the first polymer configuration;

wherein the reservoir portion further comprises a separation wall, wherein a top edge of the separation wall is distanced from the lid, with a fluid exchange port disposed between the top edge of the separation wall and the lid; and wherein the lid includes at least one anchor which is configured to:

protrude downwards from the base of the lid to anchor the lid to the reservoir portion;

press fit against the back wall and the separation wall; and has a main body and wings perpendicular to the main body, wherein edges of the wings slope downwards into a retention profile.

5. The ink cartridge of claim 4, wherein the lid further includes:

a foam chamber retention profile to fit the lid to the reservoir portion, wherein the anchor is higher than the foam chamber retention profile.

6. The ink cartridge of claim 5 wherein the anchor is flush with the foam chamber retention profile.

7. The ink cartridge of claim 4 wherein the lid includes foam retention ribs, and the anchor is higher than the foam retention ribs.

8. The ink cartridge of claim 1 wherein the cartridge includes at least 11 grams of pigment ink.

9. The ink cartridge of claim 1 wherein the polymers are polypropylene.

10. The ink cartridge of claim 1 wherein the front and back wall include a mold parting line over the middle along the height of the wall.

11. The ink cartridge of claim 1 wherein a radius between the latch handle and the front wall is at least 0.23 millimeters.

12. The ink cartridge of claim 1 wherein a radius between the side wall and the front or back wall is at least 0.8 millimeters.

13. The ink cartridge of claim 1, wherein the front wall, the back wall and the two side walls are connected with corner fillets which improve strength of the first polymer configuration.

14. The ink cartridge of claim 1, wherein the lid extends to, but does not protrude from, the circumferential top edge of the reservoir portion.

15. The ink cartridge of claim 1, wherein the reservoir portion further comprises a separation wall, wherein a top edge of the separation wall is distanced from the lid, with a fluid exchange port disposed between the top edge of the separation wall and the lid.

16. The ink cartridge of claim 1, wherein the latch handle is attached to the back wall via a live hinge.

17. The ink cartridge of claim 1, wherein the latch handle has an angle of between 15 and 30 degrees with respect to the back wall.

* * * * *